US006547230B2

(12) United States Patent
Sato

(10) Patent No.: US 6,547,230 B2
(45) Date of Patent: Apr. 15, 2003

(54) STAPLER WITH VARIABLE STAPLE ENGLISH

(75) Inventor: Tetsuya Sato, Kawasaki (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 31 days.

(21) Appl. No.: 09/811,531

(22) Filed: Mar. 20, 2001

(65) Prior Publication Data

US 2002/0171192 A1 Nov. 21, 2002

(51) Int. Cl.[7] ..... B25C 5/04

(52) U.S. Cl. ..... 270/58.08; 399/410; 227/84; 227/2

(58) Field of Search ..... 270/58.08; 399/410; 227/2, 3, 5, 88, 84

(56) References Cited

U.S. PATENT DOCUMENTS 3,848,790 A * 11/1974 Verwey et al. ..... 227/90
4,356,947 A * 11/1982 Marshall et al. ..... 227/152
4,358,040 A * 11/1982 Stokes ..... 227/155
4,546,910 A * 10/1985 Logtens ..... 140/93 D
4,898,314 A * 2/1990 Stroh ..... 227/3
5,788,139 A * 8/1998 Sikora ..... 227/82
5,938,388 A * 8/1999 Bloser et al. ..... 29/13
6,119,911 A * 9/2000 Funk et al. ..... 227/5

FOREIGN PATENT DOCUMENTS

| | | | |
|---|---|---|---|
| JP | 2-111501 | * | 4/1990 |
| JP | 2-134205 | * | 5/1990 |
| JP | 6-206179 | | 7/1994 |
| JP | 6-218675 | | 8/1994 |
| JP | 7-187487 | | 7/1995 |
| JP | 10-272608 | * | 10/1998 |

* cited by examiner

*Primary Examiner*—Patrick H. Macky
(74) *Attorney, Agent, or Firm*—Foley & Lardner

(57) ABSTRACT

A staple apparatus of the present invention comprises a staple wire unit for storing a staple wire as a roll-like form which provides a staple with which a stack of sheet materials is bound, a feeding roller for feeding the staple wire which is stored in the storage section in accordance with a stacked amount of sheets, a cutting device for cutting the staple wire fed by the feeding roller to form a staple, a conveying clip for conveying the staple formed by the cutting device to a predetermined position, and a stapling apparatus bending the staple conveyed by a conveying clip to the predetermined position to staple the stacked sheet materials.

21 Claims, 3 Drawing Sheets

STAPLER WITH VARIABLE STAPLE ENGLISH

BACKGROUND OF THE INVENTION

The present invention relates to a stapling apparatus assembled for example, on a sorter of an electrophotographic apparatus and adapted to insert a staple into a stack of copied sheets at a predetermined position and bind the copied sheets together and an image forming apparatus.

This kind of stapling apparatus has a flat line array of staples arranged relative to a plurality of copied sheets.

In the case where the copied sheets are to be stapled, one forward-end side staple of the flat line staple array is pushed down by a staple push-down plate into abutting engagement with a staple bending plate and bent. And the bent staple is further pressed down by the staple press-down plate and, by doing so, the staple bending plate yields against the push-down load and is moved aside, while, on the other hand, the forward end portions of the bent staple penetrate into the copied sheets on an anvil and are bent inwardly at a recess in the anvil to staple the copied sheets.

Incidentally, the length of the staple is normally fixed and, in the case of stapling 25 copied sheets with a binding width of 11 mm for example, the optimal length of the staple is of the order of 24 mm.

The forward end width of the staple bending plate is 10 mm and the bending width of the staple is about 11 mm, so that this bending width provides a binding width relative to the copied sheets.

In the prior art, however, the binding width is normally constant, not depending upon the number of copied sheets involved and, when, for example, 50 copied sheets are stapled, the bent forward end widths of the staple are only 2.5 mm and a lowest layer sheet page and adjacent pages are liable to be separated, thus providing no adequate stapling.

Further, if about 2 copied sheets are stapled, then the bent forward end widths of the staple is 6.5 mm and an interference occurs at those bent forward end portions of the staple.

In order to solve this problem, a stapling apparatus has been developed which includes a changing mechanism for changing the bending position of a staple, whereby it is possible to change the bending dimension, that is, the binding width, of the staple in accordance with the thickness of a stack of copied sheets.

Also developed is a stapling apparatus having a plurality of different lengths of staples in which a given staple is selected according to the thickness of a stack of copied sheets and, by doing so, better stapling can be provided even if the binding width is constant.

However, the apparatus including the changing mechanism for changing the bending position of the staple requires an additional step of operating the changing mechanism and involves an inconvenience that the stapling efficiency is lowered.

Further, in the stapling apparatus having a plurality of different lengths of staples, a selecting mechanism is required to select the staple and it involves a high cost and an inconvenience of requiring more occupation space.

BRIEF SUMMARY OF THE INVENTION

It is accordingly the object of the present invention to provide a low-cost stapling apparatus which can provide better stapling without arranging any changing mechanism for changing the bending position of the staple and arranging any different lengths of staples and an image forming apparatus.

The stapling apparatus of the present invention comprises a storage section for storing a staple wire as a roll-like form which provides a staple with which a stack of sheet materials is bound, feeding means for feeding the staple wire which is stored within the storage section in accordance with the stacked amount of sheet materials, cutting means for cutting the staple wire fed by the feeding means to form a staple, conveying means for conveying the staple formed by the cutting means to a predetermined position, and stapling means for bending the staple conveyed by the conveying means to the predetermined position to staple the stacked sheet materials.

An image forming apparatus of the present invention comprises an image carrier for carrying an image, image forming means for forming an image on the image carrier, transferring means for transferring the image which is formed by the image forming means to a transfer medium, a discharging section for allowing the transfer medium with an image transferred by the transferring means thereto to be discharged, and a stapling apparatus provided on the discharging section and binding the transfer medium stacked on the discharging section by a staple, wherein the stapling apparatus comprises a storage section for storing a staple wire as a roll-like form which provides a staple, feeding means for feeding the staple wire which is stored within the storage section in accordance with a stacked amount of the transfer medium, cutting means for cutting the staple wire fed by the feeding means to form a staple, conveying means for conveying the staple which is formed by the cutting means to a predetermined position, and stapling means for bending the staple which is conveyed by the conveying means to the predetermined position and stapling the stacked transfer medium.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The embodiment of the present invention will be described below with reference to the accompanying drawing.

Figure 1:
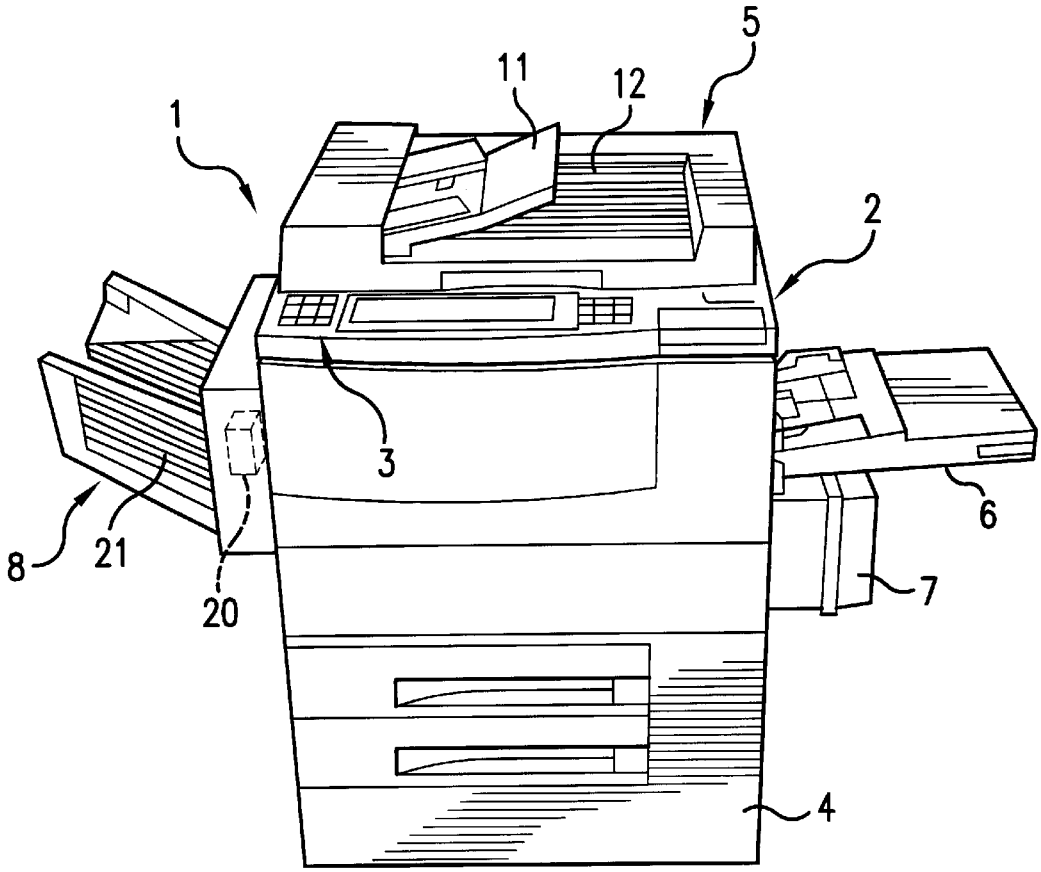
FIG. 1 is a perspective view showing an electrophotographic copier according to one embodiment of the present invention.

FIG. 1 is a perspective view showing an electrophotographic copier as an image forming apparatus according to one embodiment of the present invention.

The electrophotographic copier 1 includes an apparatus body 2 having a later-described image forming section 10 therein. An automatic document conveying means 5 is provided at the upper surface section of the apparatus body 2. The automatic document conveying means 5 is so configured as to have a document placing tray 11 for placing a document thereon, a conveying system for conveying a document on the document placing tray 11 onto a document glass of the apparatus body 2 and a document discharging tray 12 for receiving the document conveyed from the document glass. An operation panel 3 is provided as an operation means on a front side of an upper surface of the apparatus body, the operation means constituting an input means and notifying means.

On the side of the apparatus body 2, a sheet supplying cassette 6 and large quantity sheet cassette 7 are arranged vertically and, on the other side of the apparatus body 2, a sorter 8 is arranged to receive a sheet discharged from the apparatus body 2 and sort/stack it. The sorter apparatus 8 has an incorporated stapling apparatus 20 for stapling a stack of sorted sheets.

Figure 2:
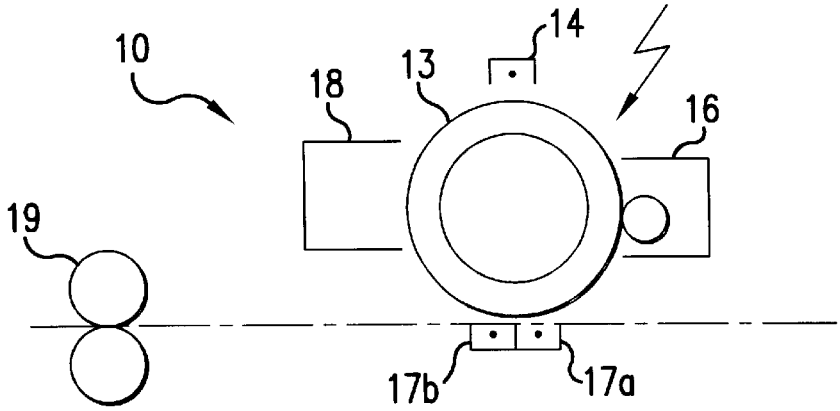
FIG. 2 is a view showing a structure of an image forming apparatus.

FIG. 2 is a view showing an image forming section 10.

The image forming section 10 is equipped with a photosensitive drum 13 as an image carrier rotating along a direction as indicated by an arrow. Around the circumference of the photosensitive drum 13, a charger 14, developing section 16, transfer/separation units 17*a*, 17*b* and cleaning unit 18 are arranged along the rotation direction of the drum 13.

At a time of forming an image, a document on a document glass is scanned by a light scanning means, not shown, with light and the reflected light from the document is directed onto the photosensitive drum 13 as indicated by an arrow to form an electrostatic latent image corresponding to a document image. The surface of the photosensitive drum 13 is initially uniformly charged by the charger 14 to a predetermined potential. The electrostatic latent image formed on the photosensitive drum 13 is sent to a developing unit 16 to be made visible by being supplied with a developing agent.

At this time, a sheet as a sheet material is conveyed between the photosensitive drum 13 and the transfer unit 17*a* and the visible image on the photosensitive drum is transferred to the sheet under an action of the transfer unit 17*a*. After this transfer, the sheet is separated from the photo-sensitive drum 13 under an action of the separator 19 and is conveyed to the fixing unit 19. At the fixing unit 19, the image is fixed to the sheet and discharged onto the sorter 8 where the sheet is sorted/stacked.

Figure 3:
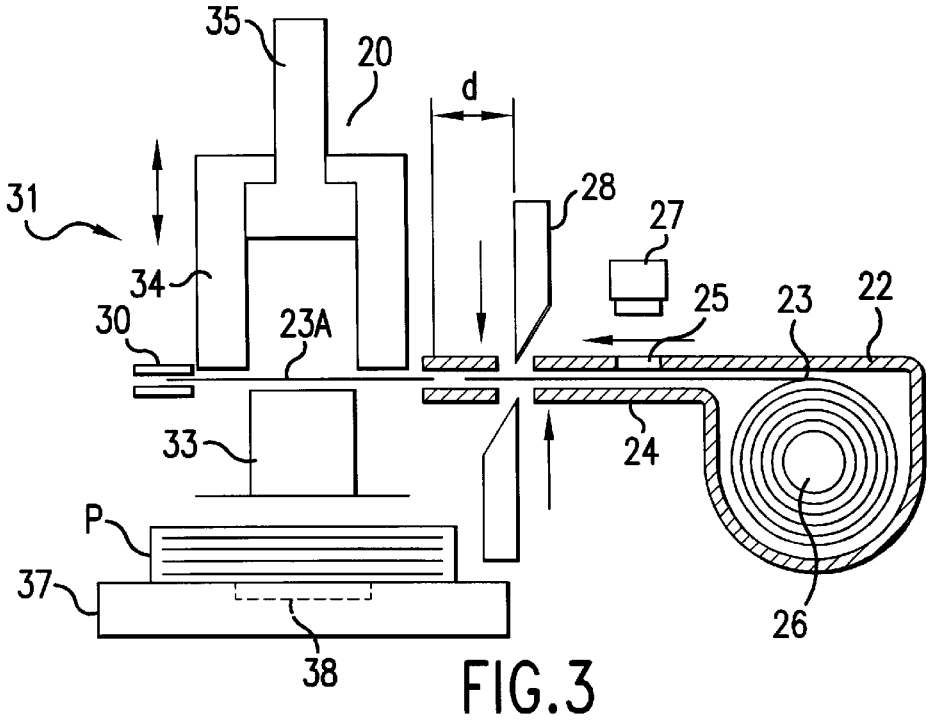
FIG. 3 is a view showing a structure of a stapling apparatus.

FIG. 3 is a view showing a structure of the stapling apparatus 20.

The stapling apparatus 20 includes a staple wire unit 22 as a storage section. Within the staple wire unit 22, a roll of staple wire is stored around a feeding roller 26 as a feeding means. A cylindrical staple wire guide 24 is formed integral with the staple wire unit 22. The staple wire guide 24 allows the shape of the staple wire portion to be straightened when the staple wire is passed through the staple wire guide. The staple wire unit is so provided as to be exchangeable and, when a full roll of a staple wire is fed out of the feeding roller, an exchange is made to a new staple wire unit 22.

A window 25 is provided at the upper surface portion of the staple wire guide 24 and a detection sensor 27 is provided above the window 25 to allow the staple wire 23 to pass below the window 25.

In the neighborhood of the staple wire guide 24 a cutting device 28 is arranged as a cutting means for cutting the staple wire 23. At a forward end side of the staple wire guide 24 a conveying clipping device 30, as well as a bending die unit 31, is provided for clipping a leading edge portion of the staple wire 23 fed out of the staple wire guide 24 and conveying it by doing so. A bending die unit 31 has a lower die section 33 and an upper die section 34. The lower die section 33 is formed as a block-like section and the upper die section 34 is formed as a concave-like section. An operation member 35 is connected to the upper die section 34 and the upper die section 34 is moved up and down by the operation member 35. By the down movement of the upper die section 34 a staple 36 is bent along the lower die section 33 to a U-shaped configuration.

A sheet placing base 37 is provided below the lower die section 33 to place sheets thereon. The sheet placing base 37 has a recess 38 where both end portions of the staple 36 which penetrates into the sheets P are bent inwardly.

Figure 4:
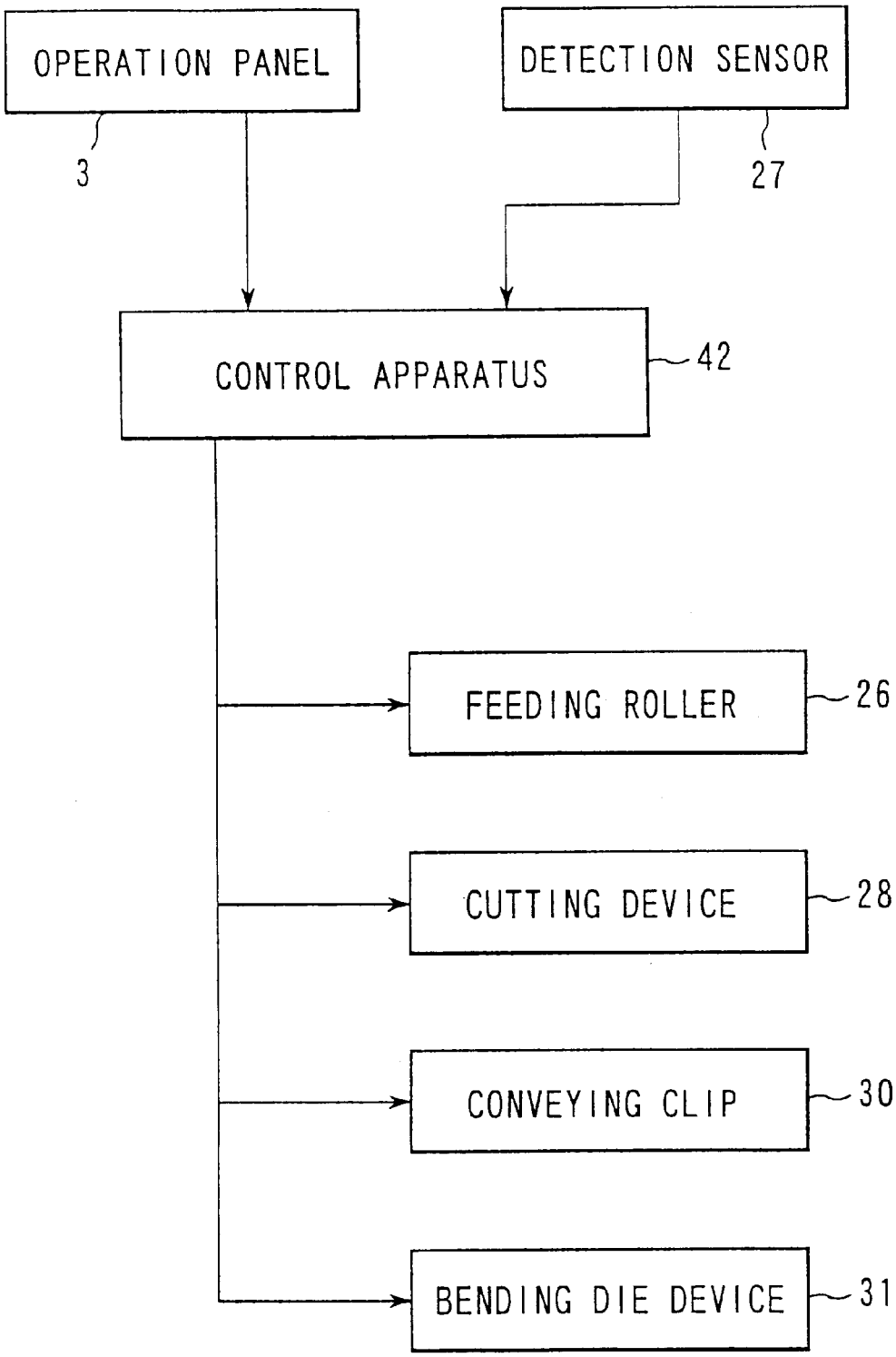
FIG. 4 is a block diagram showing a drive control system of the stapling apparatus.

FIG. 4 is a block diagram showing a drive control system of the stapling apparatus.

The operation panel 3 and detection sensor 27 are connected to a control apparatus 42 through a signal circuit. By the operation of the operation panel 3 the number of copied sheets, etc., is set and a stapling instruction is outputted. And the feeding roller 26, cutting device 28, conveying clipping device 30 and bending die unit 31 are connected to the control apparatus 42 through a control circuit.

Then, the stapling of the sheets P will be explained below.

The number of copied sheets is set by the operation of the operation panel 3 and, when a stapling instruction is outputted, the feeding roller 26 is rotated by the control apparatus 42 and the staple wire 23 is supplied out of the roller 26 and this staple wire 23 is detected by the detection sensor 27. After this detection, the staple wire 23 is fed out for a predetermined time. That is, the staple wire 23 is fed out of the staple wire unit 23 by an amount corresponding to the number of copied sheets set. When the staple wire 23 is fed a predetermined amount from the staple wire unit 22, it is cut by the cutting device 28 to provide a staple 23A. The staple 23A has its leading edge portion clipped by the conveying clip 30 and is conveyed to a bending position. After this, the bending die unit 31 is operated to move the upper die section 34 downward. By this downward movement the staple 23A is bent along the lower die section 33 to a U-shaped configuration.

The thus U-shape bent staple 23A penetrates into the sheets P after the lower die section 33 has been retracted and the forward end portions of the U-shape bent staple are bent inwardly at the recess 38 of the sheet placing base 37 to complete the stapling of the sheets P.

Figure 5:
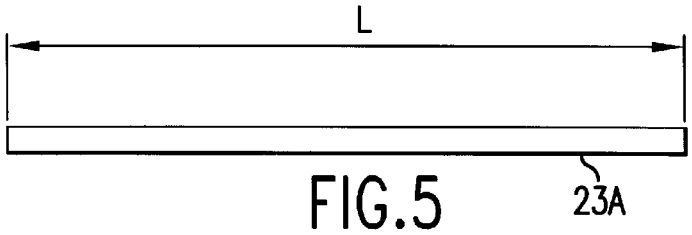
FIG. 5 shows a staple before being bent.
Figure 6:
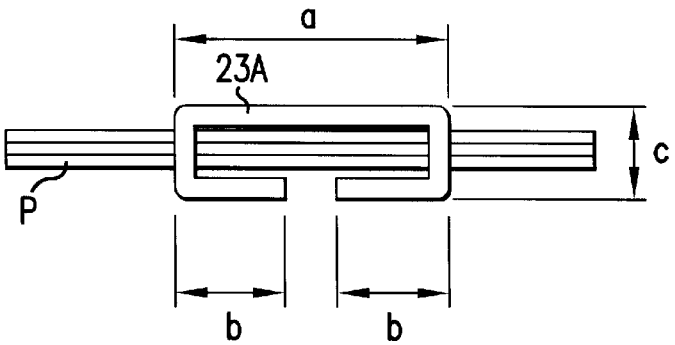
FIG. 6 is a view showing a staple by which sheets are bound together.

FIG. 5 is a front view showing the staple 23A and FIG. 6 is a view showing a state in which the sheets P are bound by the staple 23A.

The staple 23A has a length dimension L, a binding width dimension a, a thickness dimension c and the length b of the bent forward end portion.

TABLE 1

(mm)

| Number of sheets | a | b | c | L | Staple wire feeding amount |
|---|---|---|---|---|---|
| 2 | 11 | 3.5 | 0 | 18 | 9 + d |
| 25 | 11 | 3.5 | 2 | 22 | 11 + d |
| 50 | 11 | 3.5 | 4 | 26 | 13 + d |

Table 1 shows the respective dimensions corresponding to the stacked number of sheets P involved.

That is, when the stacked number of sheets P is 2, the dimension a is 11 mm, the dimension b is 3.5 mm, the dimension c is 0 mm, dimension L is 18 mm, and the staple wire feeding amount is (9+d) mm.

When the stacked number of sheets is 25, the dimension a is 11 mm, the dimension b is 3.5 mm, the dimension c is 2 mm, dimension L is 22 mm and the staple wire feeding amount is (11+d) mm.

When the stacked number of sheets is 50, the dimension a is 11 mm, the dimension b is 3.5 mm, the dimension c is 4 mm, the dimension L is 26 mm and staple wire feeding amount is (13+d) mm.

As set out above, by storing the staple wire 23 as a roll-like form within the staple wire unit 22 and cutting the feeding staple wire 23 in accordance with a stacked height of the sheets P, a staple 23A is formed and it is not necessary to, as the prior art, operate the changing device for changing a bending position of a staple in accordance with a stacked height of sheets P and it is possible to improve the processing efficiency.

Further it is not necessary to provide any selecting mechanism for selecting any staple as in the case of arranging different lengths of staples and selecting one of them. It is, therefore, possible to improve the processing efficiency and achieve low costs. Further it is also possible to advantageously save an installation space.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A stapling apparatus comprising:

a storage section for storing a staple wire as a roll-like form which provides a staple with which a stack of sheet materials is bound;

feeding means for feeding the staple wire which is stored in the storage section in accordance with a stack amount of sheet materials;

cutting means for cutting the staple wire fed by the feeding means to form a staple;

conveying means for conveying the staple formed by the cutting means to a bending position; and stapling means for bending the staple conveyed by the conveying means to the bending position and stapling the stack of the sheet materials.

2. A stapling apparatus according to claim 1, further comprising detecting means for detecting the staple wire fed by the feeding means and wherein an amount of feeding from the detection by the detecting means of the staple wire is set as an amount of staple wire fed by the feeding means.

3. A stapling apparatus according to claim 1, wherein the conveying means has a conveying clip for clipping the leading edge portion of the staple wire and conveying the stable wire.

4. A stapling apparatus according to claim 1, wherein the stapling means has a fixed die section and a movable die section for bending the staple along the fixed die section.

5. A stapling apparatus according to claim 1, wherein the storage section is exchangeable.

6. A stapling apparatus according to claim 1, wherein a cylindrical guide section is formed on the storage section and the staple wire is fed along the guide section to cause the shape of the staple wire to be straightened.

7. An image forming apparatus comprising:

an image carrier for carrying an image;

image forming means for forming an image on the image carrier;

transferring means for transferring the image which is formed by the image forming means on the image carrier to a transfer medium;

a discharging section for allowing the transfer medium with the image transferred by the transferring means thereto to be discharged; and a stapling apparatus provided on the discharging section and binding the transfer medium stacked on the discharging section by a staple, wherein the stapling apparatus comprises a storage section for storing a staple wire as a roll-like form which provides a staple, feeding means for feeding the staple wire which is stored in the storage section in accordance with a stack amount of transfer medium, cutting means for cutting the staple wire fed by the feeding means to form a staple, conveying means for conveying the staple formed by the cutting means to a bending position, and stapling means for bending the staple which is conveyed by the conveying means to the bending position and stapling the stacked transfer medium.

8. An image forming apparatus according to claim 7, further comprising setting means for setting the number of image formed sheets and controlling means for determining an amount of staple wire fed by the feeding means in accordance with the number of image formed sheets set by the setting means.

9. An image forming apparatus according to claim 7, further comprising detecting means for detecting the staple wire fed by the feeding means and wherein an amount of staple wire fed from the detection by the detecting means of the staple wire is set as an amount of the staple wire fed by the feeding means.

10. An image forming apparatus according to claim 7, wherein the conveying means has a conveying clip for clipping the leading edge portion of the staple wire and conveying the staple wire.

11. An image forming apparatus according to claim 7, wherein the stapling means has a fixed die section and a movable die section for bending the staple along the fixed die section.

12. An image forming apparatus according to claim 7, wherein the storage section is exchangeable.

13. An image forming apparatus according to claim 7, wherein a cylindrical guide section is formed on the storage section and the staple wire is fed along the guide section to cause the shape of the staple wire to be straightened.

14. A stapling apparatus comprising:

a storage section which stores a staple wire as a roll-like form which provides a staple with which a stack of sheet materials is bound;

a feeding roller which feeds the staple wire which is stored in the storage section in accordance with a stack amount of sheet materials;

a cutting device which cuts the staple wire fed by the feeding roller to form a staple;

a conveying device which conveys the staple formed by the cutting device to a bending position; and a bending die unit which bends the staple conveyed by the conveying device to the bending position and staples the stack of the sheet materials.

15. A stapling apparatus according to claim 14, further comprising a detection sensor which detects the staple wire fed by the feeding roller and wherein an amount of feeding from the detection by the detection sensor of the staple wire is set as an amount of staple wire fed by the feeding roller.

16. A stapling apparatus according to claim 14, wherein the conveying device has a conveying clip which clips the leading edge portion of the staple wire and conveys the staple wire.

17. A stapling apparatus according to claim 14, wherein the bending die unit has a fixed die section and a movable die section which bends the staple along the fixed die section.

18. A stapling apparatus according to claim 14, wherein the storage section is exchangeable.

19. A stapling apparatus according to claim 14, wherein a cylindrical guide section is formed on the storage section and the staple wire is fed along the guide section to cause the shape of the staple wire to be straightened.

20. A stapling method in a stapling apparatus comprising:

feeding a staple wire which is stored as a roll-like form in a storage section in accordance with a stack amount of transfer medium;

cutting the fed staple wire to form a staple;

conveying the cut staple to a bending position;

bending the staple which is conveyed to the bending position; and stapling a stack of transfer medium.

21. A stapling apparatus according to claim 1, wherein the conveying means conveys the staple along a direction that is substantially perpendicular to a direction of movement of the cutting means that provides a cutting of the staple.

* * * * *